US009474435B2

(12) United States Patent
Sendor et al.

(10) Patent No.: US 9,474,435 B2
(45) Date of Patent: Oct. 25, 2016

(54) DISPENSER OPTIMIZATION FOR EASIER CLOSING

(71) Applicant: BSH Home Appliances Corporation, Irvine, CA (US)

(72) Inventors: Janusz Sendor, New Bern, NC (US); Scott Tarcy, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 554 days.

(21) Appl. No.: 13/740,295

(22) Filed: Jan. 14, 2013

(65) Prior Publication Data

US 2014/0196754 A1 Jul. 17, 2014

(51) Int. Cl.
*A47L 15/44* (2006.01)

(52) U.S. Cl.
CPC ..... *A47L 15/44* (2013.01); *A47L 15/4409* (2013.01)

(58) Field of Classification Search
None
See application file for complete search history.

(56) References Cited

U.S. PATENT DOCUMENTS

| | | | | |
|---|---|---|---|---|
| 3,402,853 | A * | 9/1968 | Perl | 222/651 |
| 5,261,432 | A | 11/1993 | Sandrin | |
| 5,836,180 | A | 11/1998 | Herman-Latack et al. | |
| 5,884,821 | A | 3/1999 | Wilhelmstaetter et al. | |
| 5,971,645 | A * | 10/1999 | Fukushima et al. | 401/183 |
| 2009/0145922 | A1* | 6/2009 | Cerruti | A47L 15/4409 222/1 |
| 2009/0288687 | A1* | 11/2009 | Marone | A47L 15/4409 134/93 |
| 2011/0073622 | A1 | 3/2011 | Webster et al. | |
| 2012/0138101 | A1* | 6/2012 | Francisco | A47L 15/0028 134/25.2 |

FOREIGN PATENT DOCUMENTS

IT EP 1723893 A2 * 11/2006 ..... A47L 15/4409

* cited by examiner

*Primary Examiner* — Michael Barr
*Assistant Examiner* — Cristi Tate-Sims
(74) *Attorney, Agent, or Firm* — Michael E. Tschupp; Andre Pallapies

(57) ABSTRACT

A detergent dispenser for dispensing detergent in a domestic appliance, the detergent dispenser comprising a housing, a container defined in said housing and adapted to store detergent, a movable cover adapted to close and seal the container, and at least one extension depending from the cover, said at least one extension adapted to clear detergent from a perimeter of the container as the cover moves.

27 Claims, 7 Drawing Sheets

DISPENSER OPTIMIZATION FOR EASIER CLOSING

FIELD OF THE TECHNOLOGY

The present technology relates to a detergent metering device for a domestic appliance, e.g. a dishwasher. More particularly, the present technology relates to an enhancement to a cover for the detergent dispenser that makes closing the cover easier.

BACKGROUND OF THE TECHNOLOGY

In the modern kitchen, one common appliance is the dishwasher, or in more specific terms, the automatic dishwasher. Most automatic dishwashers share certain basic components. There is a compartment in which the dishes or crockery are placed and enclosed for treatment or washing. Commonly, there is at least one rack to hold the items to be cleaned. A hinged door or sliding drawer is commonly used to enclose the compartment and its contents. Also, there are commonly a number of nozzles for spraying water to facilitate the cleaning within the compartment. Lastly, there is a dispenser for detergent to release detergent into the compartment during the treatment process and the detergent dispenser will have a cover to hold the detergent therein. An exemplary dishwasher having a detergent dispenser is shown in Wilhemstaetter et al., U.S. Pat. No. 5,884,821, which is incorporated by reference herein. Of course, it is to be understood that these components are common and basic, and that individual appliances will differ in the make-up of their components.

Another commonality between modern automatic dishwashers is the basic steps of the cleaning cycle. Generally, there is first a pre-wash stage in which water is sprayed in the compartment to wet the items to be cleaned and any soilage thereon. Once the items have been sprayed, detergent is released into the compartment and further spraying occurs with the detergent mixing with the water to remove the soilage from the dishes and crockery. Subsequently, a rinse stage occurs to wash away the detergent and any remaining soilage. Finally, a drying stage occurs during which the dishes and/or crockery are dried. Again, it is to be understood that these steps are common and basic, however, individual dishwashers may operate with a number of different cycles having a variety of steps ordered in different ways.

Before the dishwasher is operated though, it must be loaded with the items to be cleaned and detergent must be added to the dispenser. The amount of detergent used is generally dependent on the level of soilage and number of items to be cleaned. Detergent is commonly sold in bulk, in liquid, tablet, or powder form. Therefore, when the detergent dispenser is loaded with detergent, the detergent must be poured or inserted into a container of the dispenser. Often though, the user will spill the detergent around the container of dispenser and the presence of the detergent around the container of the dispenser will make it difficult to close the dispenser cover and seal the detergent in the container of the dispenser.

A need has developed to address one or more shortcomings of the prior art.

SUMMARY OF THE TECHNOLOGY

One aspect of the present technology is to provide a cover for a container of a detergent dispenser that overcomes one or more of the shortcomings of the prior art.

Another aspect of the present technology is directed to a detergent dispenser for dispensing detergent in a domestic appliance. The detergent dispenser comprises a housing, a container defined in said housing and adapted to store detergent, a movable cover adapted to close the container, and at least one extension depending from the cover, said at least one extension adapted to clear detergent from a perimeter of the container as the cover moves.

In examples, (a) the cover is adapted to slide toward the container to close the container, (b) the at least one extension comprises a plurality of bristles, (c) the at least one extension comprises a plastic tab, (d) the at least one extension and the cover comprise a one-piece component, (e) the at least one extension is a separate component from the cover, (f) the at least one extension comprises a pair of extensions each located at an opposite side of the cover and both at a proximal end of the cover that is proximal to the container in an open position, (g) the detergent dispenser comprises a raised lip disposed about the perimeter of the container, and/or (h) the detergent dispenser comprises at least one channel or groove defined at least partially on the housing by the raised lip of the container and extending at least partially along a corresponding edge of the perimeter of the container.

Another aspect of the present technology is directed to a method for filling detergent in a container of a detergent dispenser of a domestic appliance, the dispenser having a cover with at least one extension depending therefrom. The method comprises pouring detergent into the container and closing the cover over the container such that any detergent spilled around a perimeter of the container is swept clear by the at least one extension.

In examples, (a) closing the cover comprises sliding the cover, (b) the at least one extension comprises a flexible, plastic tab or a plurality of bristles, (c) the at least one extension comprises a pair of extensions, each disposed at a proximal end of the cover and on an opposite side of the cover, said proximal end being proximal to the container when the cover is in an open position, (d) a raised lip is disposed at least partially about a perimeter of the container, and/or (e) a housing and said raised lip define a channel or groove through which the at least one extension travels when the cover is moved.

Another aspect of the present technology is directed to a cover for closing a container, said cover adapted to seal detergent in said container. The cover comprises at least one extension depending from the cover in a direction of the container and adapted to follow a portion of a perimeter of the container when the cover travels between open and closed positions, wherein the at least one extension is adapted to push detergent away from a perimeter of the container when the cover is moved.

In examples, (a) the cover is adapted to slide toward the container to close the container, (b) the at least one extension comprises a plurality of bristles, (c) the at least one extension comprises a plastic tab, (d) the at least one extension and the cover are a one-piece component, (e) the at least one extension is a separate component from the cover, (f) the at least one extension is located at a proximal edge of the cover, said proximal edge being proximal to the container when the cover is an open position, (g) the at least one extension comprises a pair of extensions, and/or (h) each of the pair of extensions is located at an opposite side of the cover.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of the present technology. In such drawings.

DETAILED DESCRIPTION OF ILLUSTRATED EMBODIMENTS

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1:
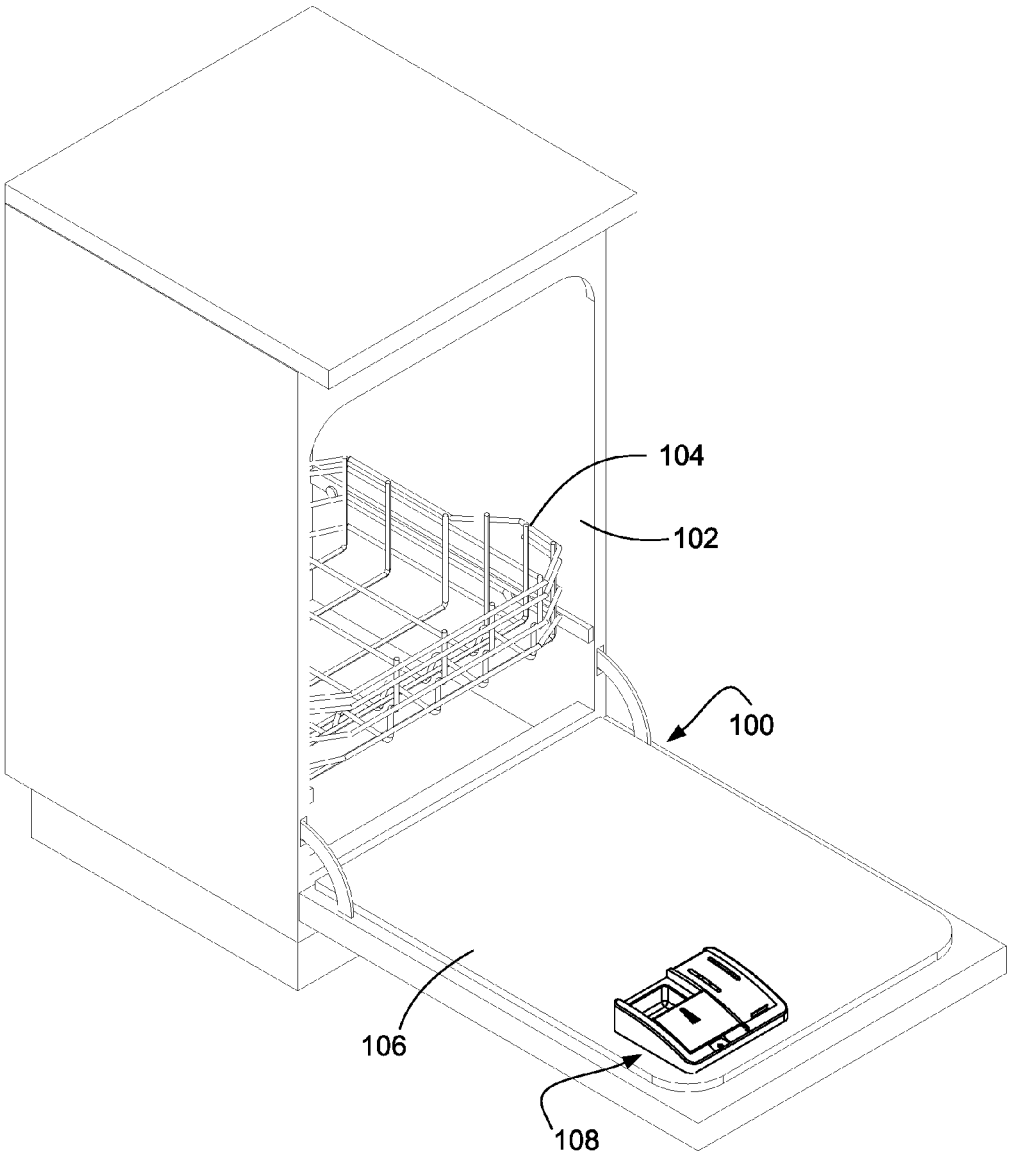
FIG. 1 is a perspective view of a domestic appliance having a detergent dispenser, according to an example of the present technology.

FIG. 1 shows a perspective view of a domestic appliance 100 that treats contents (not shown) with a compartment 102 and a door 106 to close and seal the compartment during treatment. A rack 104 in the compartment supports the contents during treatment. A detergent dispenser 108, in this example, is mounted to the door 106 for dispensing detergent during treatment. The door 106 is in an open position. In this example of the present technology, the domestic appliance 100 is a dishwasher and the compartment 102 is a washing compartment. In the present example, the dishwasher treats its contents by washing and/or drying the contents and the contents may be dishes, crockery, glassware, frying pans, cookie sheets, cutting boards, bowls, pots, etc. It should be appreciated, however, that the appliance is not limited to a dishwasher and could be any other common domestic appliance that requires detergent during treatment, e.g. a clothes washing machine.

Figure 2:
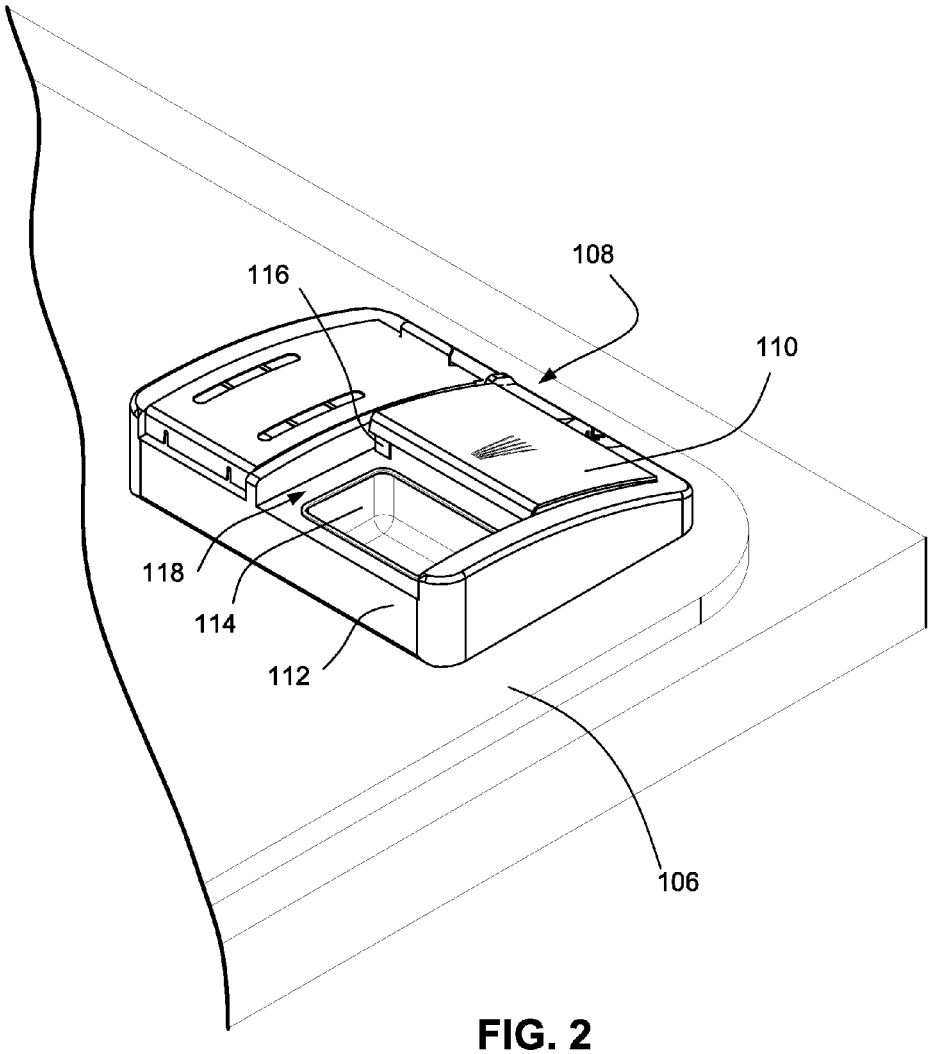
FIG. 2 is a detailed perspective view of a detergent dispenser mounted to a door of a domestic appliance, according to an example of the present technology.
Figure 6:
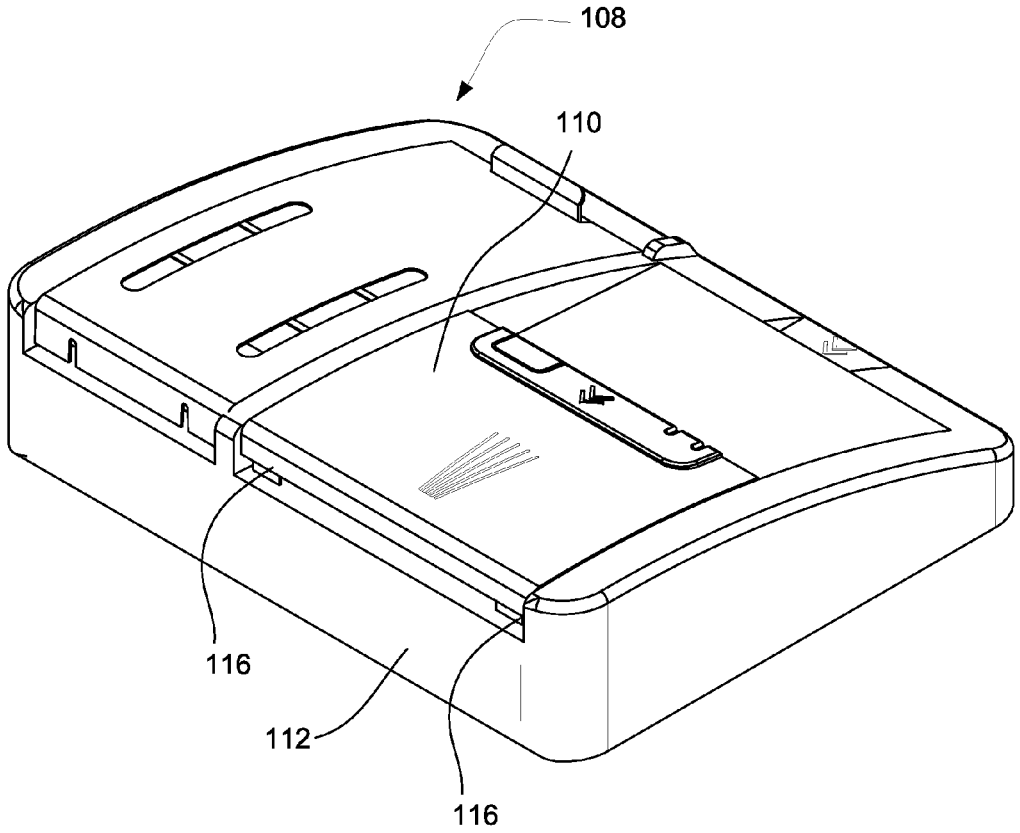
FIG. 6 is a detailed perspective view of the detergent dispenser with the cover in a closed position, according to an example of the present technology.

FIG. 2 is a detailed perspective view of the detergent dispenser 108 mounted to the door 106 of the dishwasher. The detergent dispenser 108 includes a housing 112 and cover 110 movably attached thereto. A container 114 is formed in the housing 112. The container 114 holds the detergent therein prior to release of the detergent by the detergent dispenser 108 during treatment. The cover 110 has at least one extension 116 extending toward the housing 112 from the cover. The cover 110, in this view of this example, is in its open position to expose the interior of the container 114. In the open position, prior to beginning treatment, the user will be able to add detergent to the container 114 by pouring the detergent into the container. The detergent is commonly sold to the user in bulk as a powder, a liquid, or a tablet. The user will then close the cover 110 over the filled container 114 by sliding it to the closed position, as shown in FIG. 6. The user may close the cover 110 over the container 114 by sliding the cover laterally between open and closed positions. In other words, the cover 110 and the door 106 are defined on two separate planes that remain substantially parallel in all positions of the door and cover. Once the cover 110 is closed over the container 114 and the rack 104 is loaded with contents, the door 106 is closed and treatment may be started. The detergent will be released automatically during treatment by the detergent dispenser 108.

Figure 3:
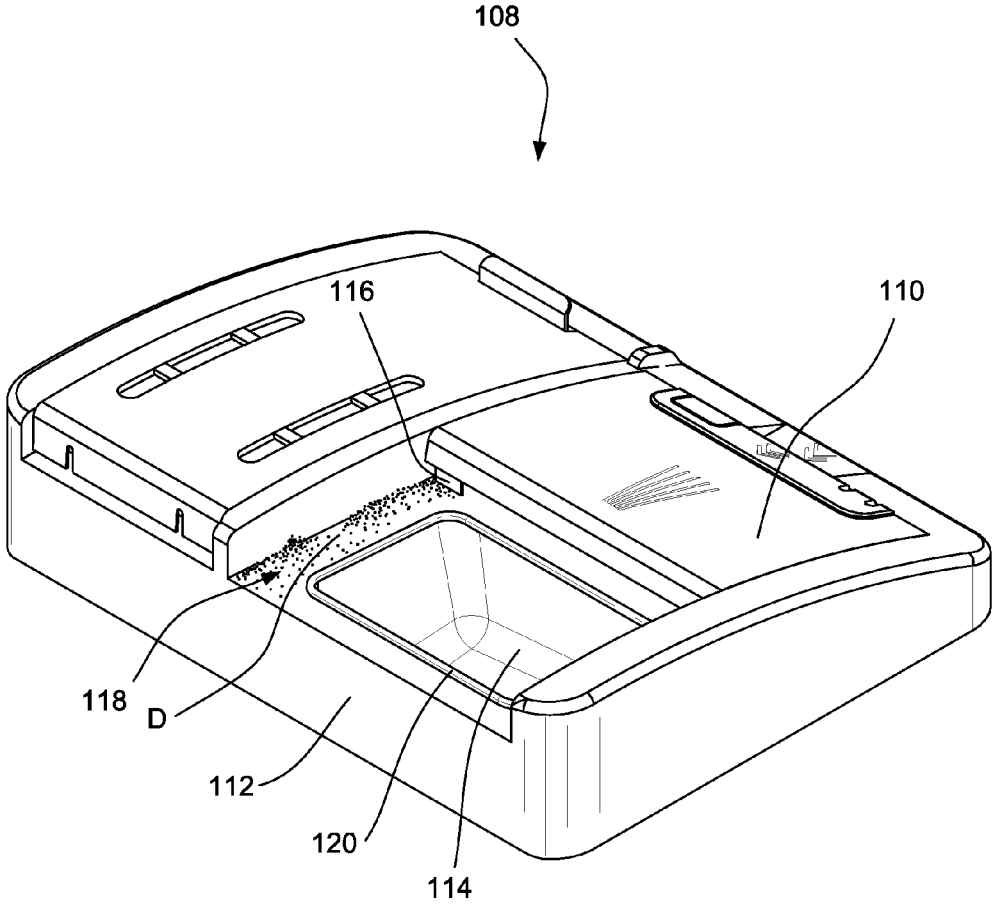
FIG. 3 is another detailed perspective view of a detergent dispenser with a cover in an open position, according to an example of the present technology.

FIG. 3 shows a further detailed perspective view of the detergent dispenser 108. While pouring the detergent D into the container 114, the user may spill the detergent into the channels 118 around the container. Often detergent in powder form is fairly coarse and will provide resistance against the closing of the cover 110 over the container 114. Similarly, liquid detergent commonly has a high viscosity such that it cannot be readily displaced by the closing cover 110 and will resist its motion. Therefore, in the example of the present technology shown in FIG. 3 extensions 116 have been added to the cover 110 to facilitate easier closing of the cover. The extensions 116 act to push detergent from the path of the cover 110 as it is slid closed. While it is not best shown in FIG. 3, there may be two extensions 116 that extend from the cover 110 at opposite corners proximal to the container. Such an arrangement is better shown in FIGS. 6-8. It should also be noted that common dishwashers, such as the one shown in these figures, the cover 110 is closed manually by the user.

The channels or grooves 118 are defined on either side of the container 114 and into the housing 112. The container 114 may also include a raised lip 120 disposed about its perimeter. This raised lip 120 further defines the channels or grooves 118. A rubber seal (not shown) may also be disposed about the raised lip 120 or it may depend from the inside of the cover 110 to seal the detergent in the container 114 when the cover is in the closed position. In an example, the rubber seal may be positioned on the interior surface of the cover 110, and may align with the raised lip 120 when the cover is moved to the position shown in FIG. 6. As shown in FIG. 3, detergent D has been spilled into the channel 118 around the container 114 and creates build up above the height of the raised lip 120. The cover 110, when closed by the user, will move with reduced resistance because the extensions 116 will sweep away spilled detergent D ahead of the cover, such that the cover can effectively seal the detergent in the container 114. However, if detergent is not cleared from the channels 118, by the extensions 116 as in the present example, the rubber seal will not effectively engage around the container 114. Furthermore, if detergent is not cleared from the channels 118, then it may be difficult or impossible to close the cover 110 over the container 114.

Figure 4:
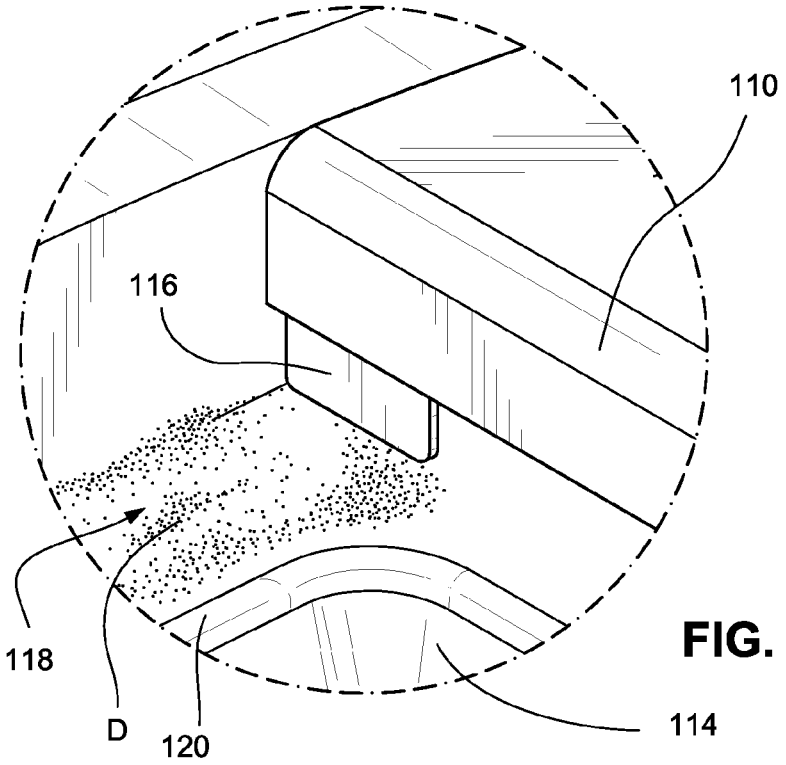
FIG. 4 is a detailed view of an extension of a detergent dispenser, according to an example of the present technology.

FIG. 4 shows a detailed view of one of the extensions 116 that extends from the cover 110. The cover 110 is in an open position and the container 114 is exposed. As in FIG. 3, detergent D has been spilled into the channel 118 defined by the housing 112 and raised lip 120. The extension 116 will push the detergent D out of the path of the cover 110 ahead of the cover, when the user closes the cover. The extension 116 in this example is a plastic tab. The plastic may be flexible such that the extension 116 will deform elastically upon encountering resistance from the detergent. Specifically, it is envisioned that the extensions may be formed from polyvinyl chloride (PVC). The extension 116 may be fixed to the cover 110 such that it does not move other than flexing upon encountering resistance from the detergent. The extension 116 may also extend beyond the housing 112 when the cover 110 is in the closed position to push the detergent D into the washing compartment. The extension 116 and the cover 110 may be formed as one piece or they may be separate components, attachable to one another. FIG. 4 also shows that a lower corner of the extension 116 may be rounded. Alternatively, the lower corner may be chamfered. Furthermore, both lower corners may be rounded or chamfered or one may be chamfered and the other rounded. In any event, either or both lower corners may be profiled to provide a better fit against the housing 112, the rubber seal, and/or the raised lip 120.

Figure 5:
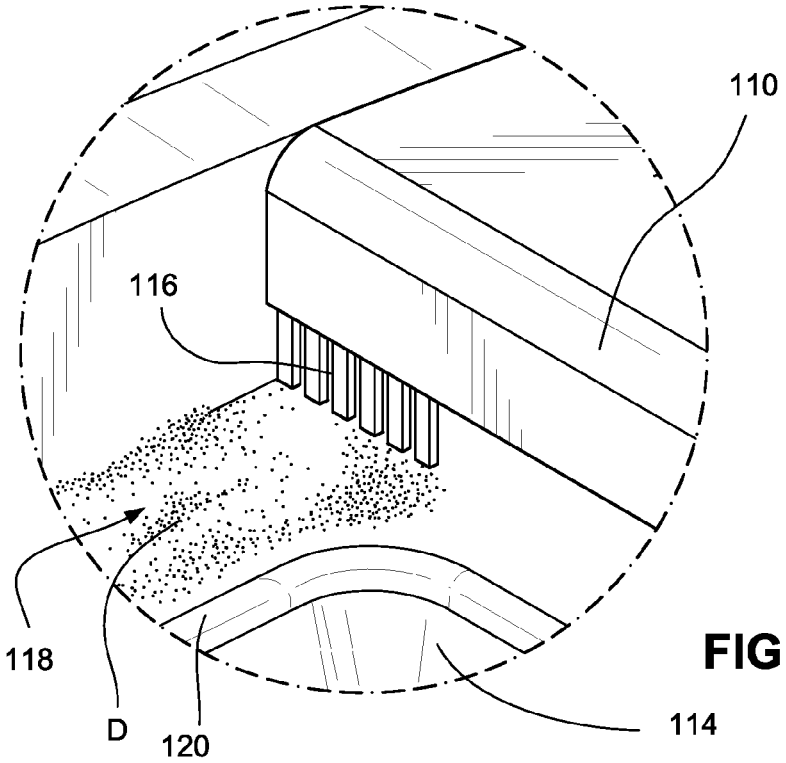
FIG. 5 is another detailed view of an extension of a detergent dispenser, according to an example of the present technology.

FIG. 5 is similar to FIG. 4, except that in this example the extension 116 is not a solid tab. Rather, the extension 116 is made from a number of bristles. The bristles may be made of any material, natural or synthetic, so long as the material can withstand the moisture and heat of the treatment process of the appliance. Particularly, it is envisioned that the bristles may be made of broomcom or broomcorn. The bristles may be flexible, such that the bristles will flex upon encountering resistance from the detergent, or the bristles may be stiff, such that the bristles will not deform upon encountering resistance from the detergent.

FIG. 6 shows a perspective view of the detergent dispenser 108 that is similar to FIG. 3. In this view, however, the cover 110 is in the closed position over the container and detergent is sealed within. Also, the extensions 116 in this view will have cleared detergent from the path of the cover 110 such that the user can close the cover with little resistance. This view shows that at each proximal corner of the cover 110 an extension 116 will be located to clear the channels or grooves 118 for closing the cover.

Figure 7:
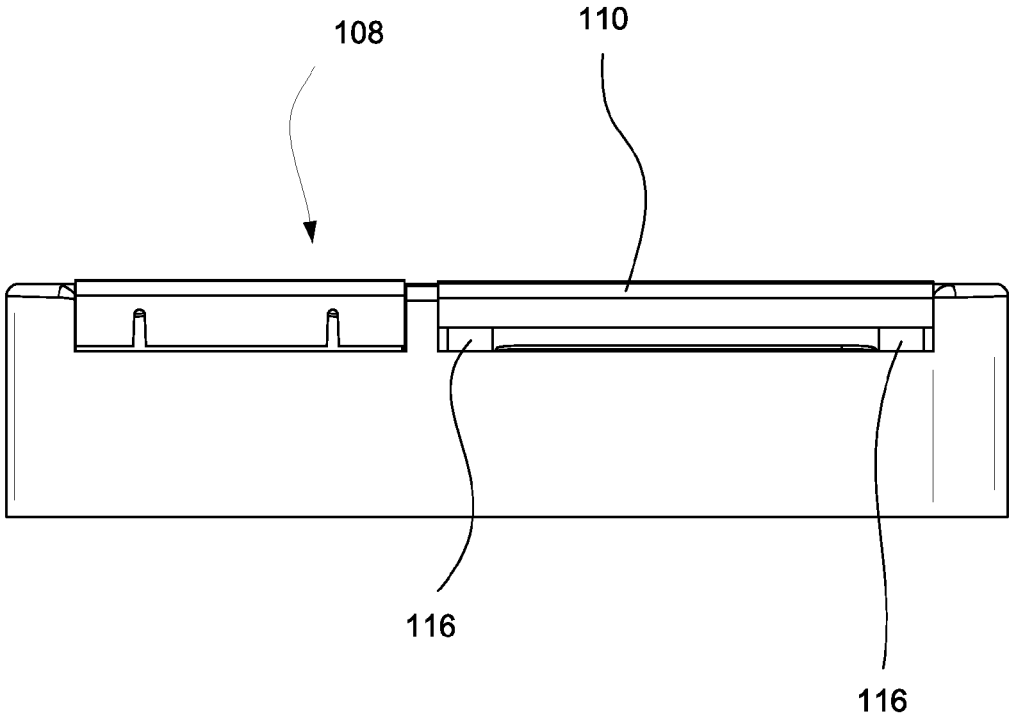
FIG. 7 is a detailed front view of the detergent dispenser with the cover in the closed position, according to an example of the present technology.

FIG. 7 shows a frontal view of the detergent dispenser 108 with the cover 110 in the closed position over the housing. This view also shows two extensions 116 depending from the proximal corners of the cover 110.

Figure 8:
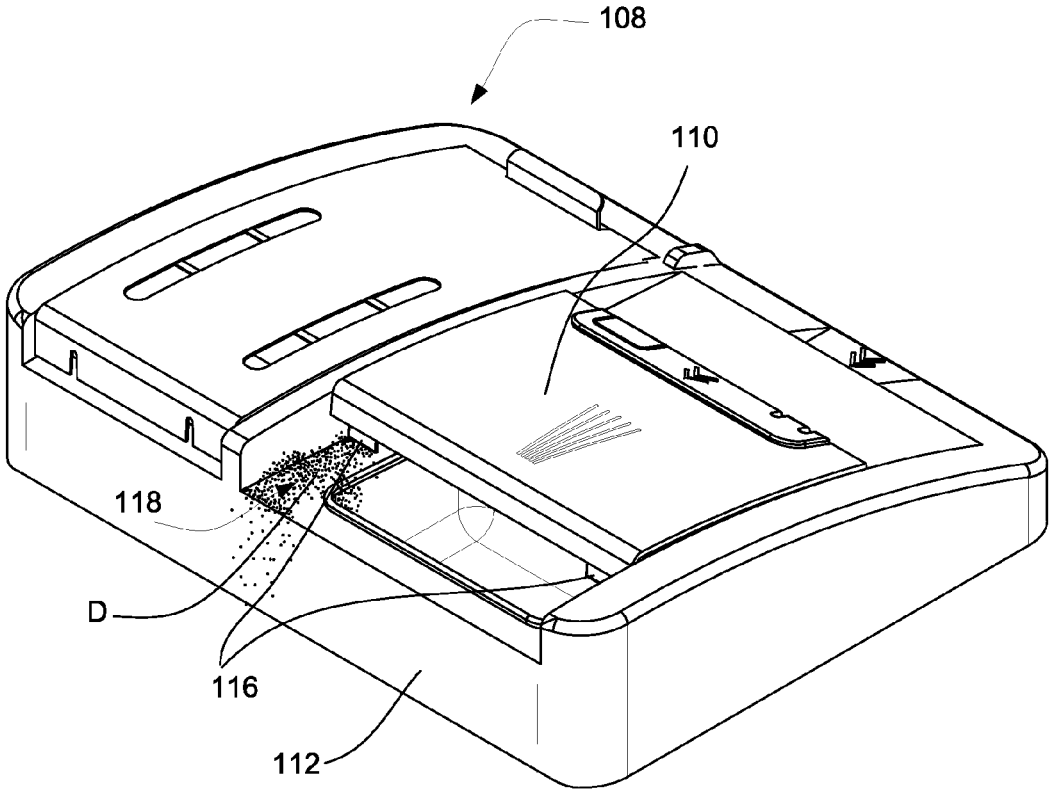
FIG. 8 is a detailed perspective view of the detergent dispenser with the cover between open and closed positions, according to an example of the present technology.

FIG. 8 shows another detailed perspective view of the detergent dispenser 108 with the cover 110 moving from the open position to the closed position. The extensions 116 are shown pushing detergent D from the channels or grooves 118 as it is closed by the user.

While the present technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the technology.

What is claimed is:

1. A detergent dispenser for dispensing detergent in a domestic appliance, the detergent dispenser comprising:

a housing structured to be mounted on the domestic appliance;

a container defined in said housing and adapted to store detergent, said container having a first side and a second side;

a movable cover adapted to slide laterally in a first direction of travel from an open position to a closed position to close and seal the container; and a pair of extensions each located at an opposite side of the cover and at a forward end of the cover with respect to the first direction of travel, the pair of extensions extending downward toward the housing from the cover, the pair of extensions adapted to pass from the first side of the container to the second side of the container to clear detergent from a perimeter of the container as the cover moves from the open position to the closed position, wherein the pair of extensions extend from the movable cover such that the pair of extentions move past the second side of the container as the cover moves into the closed position.

2. The detergent dispenser of claim 1, wherein each of the pair of extensions comprise a plurality of bristles.

3. The detergent dispenser of claim 1, wherein each of the pair of extensions comprise a plastic tab.

4. The detergent dispenser of claim 3, wherein at least one of a lower corner of each extension, distal from the cover, is either chamfered or rounded.

5. The detergent dispenser of claim 1, wherein the pair of extensions and the cover comprise a one-piece component.

6. The detergent dispenser of claim 1, wherein the pair of extensions are separate components from the cover.

7. The detergent dispenser of claim 1, wherein the pair of extensions are comprised of flexible plastic.

8. The detergent dispenser of claim 1, wherein the pair of extensions are flexibly retained in an extended position.

9. The detergent dispenser of claim 1, comprising:

a seal adapted to be disposed at the perimeter of the container.

10. The detergent dispenser of claim 1, comprising:

a raised lip disposed about the perimeter of the container.

11. The detergent dispenser of claim 10, further comprising:

at least one channel or groove defined at least partially on the housing by the raised lip of the container and extending at least partially along a corresponding edge of the perimeter of the container.

12. The detergent dispenser of claim 11, wherein the pair of extensions are adapted to travel through a corresponding at least one channel or groove as the cover moves.

13. A dishwasher for treating crockery, the dishwasher comprising:

a washing compartment adapted to contain at least one rack adapted to hold crockery located therein;

a door to seal the washing compartment; and the detergent dispenser of claim 1 disposed on an interior surface of the door.

14. A method for cleaning spilled detergent in a container of a detergent dispenser of a domestic appliance, said container having a first side and a second side, the dispenser having a housing that defines the container and a cover with a pair of extensions extending downward toward the housing from the cover, the method comprising:

pouring detergent into the container such that a portion of the detergent is spilled around a perimeter of the container; and laterally sliding the cover in a first direction of travel from an open position to a closed position to close the container such that the pair of extensions pass from the first side of the container to the second side of the container and sweeps clear any detergent spilled around the perimeter of the container, wherein the pair of extensions extend from the cover such that the pair of extensions move past the second side of the container as the cover moves into the closed position, and wherein each of the pair of extensions are located at an opposite side of the cover and at a forward end of the cover with respect to the first direction of travel.

15. The method of claim 14, wherein each of the pair of extensions comprise a flexible, plastic tab or a plurality of bristles.

16. The method of claim 14, wherein a raised lip is disposed at least partially about a perimeter of the container.

17. The method of claim 16, wherein a housing and said raised lip define a channel or groove through which the at least one extension will move when the cover is moved.

18. The method of claim 17, wherein a seal is disposed about the perimeter of said container.

19. A cover adapted to slide laterally from an open position to a closed position to close a container of a detergent dispenser, said cover adapted to seal detergent in said container, said container having a first side and a second side, the cover comprising:

a pair of extensions depending downward from the cover in a direction of the container and adapted to pass from the first side of the container to the second side of the container when the cover moves in a first direction of travel from the open position to the closed position to push detergent away from a perimeter of the container, each of the pair of extensions located at an opposite side of the cover and at a forward end of the cover with respect to the first direction of travel, wherein the pair of extensions extend extends from the cover such that the pair of extensions move past the second side of the container as the cover moves into the closed position.

20. The cover of claim 19, wherein each of the pair of extensions comprise a plurality of bristles.

21. The cover of claim 19, wherein each of the pair of extensions comprise a plastic tab.

22. The cover of claim 21, wherein the pair of extensions are comprised of flexible plastic.

23. The cover of claim 19, wherein at least one of a lower corner of each of the pair of extensions, distal from the cover, is either chamfered or rounded.

24. The cover of claim 19, wherein the pair of extensions and the cover are a one-piece component.

25. The cover of claim 19, wherein each of the pair of extensions are separate components from the cover.

26. The cover of claim 19, wherein the pair of extensions are flexibly retained in an extended position.

27. The cover of claim 19, wherein the pair of extensions are located at a proximal edge of the cover, said proximal edge being proximal to the container when the cover is an open position.

* * * * *